US010458022B2

(12) United States Patent
Brouwer et al.

(10) Patent No.: US 10,458,022 B2
(45) Date of Patent: Oct. 29, 2019

(54) OPTIMIZED PROCESS CONTROL IN THE ANTI-CORROSIVE METAL PRETREATMENT BASED ON FLUORIDE-CONTAINING BATHS

(71) Applicant: Henkel AG & Co. KGaA, Duesseldorf (DE)

(72) Inventors: Jan-Willem Brouwer, Willich (DE); Christian Stromberg, Duesseldorf (DE); Frank-Oliver Pilarek, Cologne (DE); Jens Kroemer, Neuss (DE); Fernando Jose Resano Artalejo, Duesseldorf (DE); Natascha Henze, Leverkusen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 301 days.

(21) Appl. No.: 15/618,229

(22) Filed: Jun. 9, 2017

(65) Prior Publication Data

US 2017/0283955 A1 Oct. 5, 2017

Related U.S. Application Data

(63) Continuation of application No. PCT/EP2015/078511, filed on Dec. 3, 2015.

(30) Foreign Application Priority Data

Dec. 12, 2014 (EP) ..... 14197667

(51) Int. Cl.
*C23C 22/34* (2006.01)
*C23C 22/86* (2006.01)

(52) U.S. Cl.
CPC ..... *C23C 22/34* (2013.01); *C23C 22/86* (2013.01)

(58) Field of Classification Search
CPC ..... C23C 22/34; C23C 22/86
See application file for complete search history.

(56) References Cited

U.S. PATENT DOCUMENTS

| | | | |
|---|---|---|---|
| 5,873,952 | A | 2/1999 | Hall et al. |
| 8,679,586 | B2 | 3/2014 | Czika et al. |
| 8,815,021 | B2 | 8/2014 | Brouwer et al. |

FOREIGN PATENT DOCUMENTS

| | | | |
|---|---|---|---|
| CN | 1510165 | A | 7/2004 |
| CN | 102639750 | A | 8/2012 |
| DE | 102008014465 | A1 | 9/2009 |
| DE | 102008038653 | A1 | 3/2010 |
| EP | 1571237 | A1 | 9/2005 |
| WO | 2013126632 | A1 | 8/2013 |

OTHER PUBLICATIONS

International Search Report, International Application PCT/EP215/078511, dated Feb. 16, 2016. All references cited in the International Search Report are listed herein.

*Primary Examiner* — Lois L Zheng
(74) *Attorney, Agent, or Firm* — Mary K. Cameron

(57) ABSTRACT

A method for corrosion protection treatment, comprising contacting a series of components having metallic surfaces of iron and/or zinc with a passivating aqueous pretreatment solution, present in a system tank, containing compounds of the elements zirconium and/or titanium, and contacting with a source of fluoride ions wherein a portion of the pretreatment solution is discarded and replaced with a volume portion of one or more such replenishment solutions which in total are at least of equal size, by metered addition to the system tank of the pretreatment and wherein discarding as a function of the molar ratio of the elements fluorine to zirconium and/or titanium must not drop below a predefined value, the metered addition of replenishment solution takes place such that maintaining the concentration of the elements zirconium and/or titanium in the passivating aqueous pretreatment solution in the form of water-soluble compounds is ensured.

18 Claims, No Drawings

OPTIMIZED PROCESS CONTROL IN THE ANTI-CORROSIVE METAL PRETREATMENT BASED ON FLUORIDE-CONTAINING BATHS

The present invention relates to an anti-corrosive treatment method in which a series of components having metallic surfaces made of iron and/or zinc are brought in contact with a passivating aqueous pretreatment solution which is located in a system tank and comprises compounds of the elements zirconium and/or titanium and a source for fluoride ions. In the method according to the invention, a portion of this pretreatment solution is discarded and replaced with, in sum, at least equal parts by volume of one or more such replenishment solutions by way of metering into the system tank of the pretreatment. While the discarded amount, as a function of the molar ratio of the fluoride ions to the content of zirconium and/or titanium, must not drop below a predefined value so as to ensure a permanently satisfactory anti-corrosive treatment even when the use of chemicals for regulating the pickling rate or for stabilizing the ion load is entirely dispensed with, the metered addition of replenishment solution is carried out such that the concentration of the elements zirconium and/or titanium in the passivating aqueous pretreatment solution in the form of water-soluble compounds is maintained.

Modern manufacturing lines, in which a pretreatment for applying an anti-corrosive coating is carried out prior to applying paint, are not only expected to combine a high manufacturing rate with a high level material consumption per unit of time, but also to offer high flexibility with respect to the components to be treated, combined with variations regarding the consumption of chemicals and the type of load of the baths used for this purpose. It is not uncommon, and frequent practice in the automobile supplier industry, to use one and the same pretreatment bath for coating different components having differing surface areas made of different metallic materials in a serial production operation. In contrast, in painting lines of manufacturing lines of the automotive industry, usually identical auto bodies are dipped into coating tanks, containing 150 to 450 $m^3$ of the pretreatment solution, at line speeds of 3 to 6 m/min and are in this way pretreated in a serial operation, allowing as many as 80 bodies, each having a metallic surface of approximately 100 $m^2$, to be pretreated per hour.

Continuous, precise monitoring of the pretreatment processes is fundamentally important for optimal dosing of the active components and, where necessary, of chemicals having a regulating effect, in the surface treatment of metallic surfaces of components. In modern manufacturing lines, this kind of complexity can only still be achieved if the monitoring and control of the chemicals dosing process are substantially automated to maintain a permanently optimal ratio of chemicals in the process baths, so as to be able to meet the principles of material efficiency and consistent pretreatment quality.

Specifically, the passivating pretreatment of metallic components based on acidic aqueous pretreatment solutions of fluorometallates of the elements zirconium and/or titanium has been known and established for some time as an alternative to the chromating process, which due to the toxic properties of chromium(VI) compounds is being employed to an increasingly lesser degree. In general, further active components are added to such pretreatment solutions, which are intended to further improve the anti-corrosion action and paint adhesion. EP 1 571 237 shall be cited here by way of example, which discloses a pretreatment solution suitable for different metal surfaces containing up to 5000 ppm zirconium and/or titanium, and up to 100 ppm free fluoride. The solution may additionally contain further components selected from chlorate, bromate, nitrite, nitrate, permanganate, vanadate, hydrogen peroxide, tungstate, molybdate or the respective associated acids. Organic polymers may likewise be present. After the treatment with such a solution, the metal surfaces may be rinsed with a further passivating solution.

A pretreatment bath for generating a passivating conversion coating on metal surfaces thus specifically requires a plurality of active components, which must be regularly replenished during the ongoing operation of a pretreatment bath. In the spirit of maximum material efficiency, there is a constant need to make the pretreatment methods more resource-conserving, which is to say to operate these under conditions under which the use of active components can be reduced.

In this context, DE 10 2008 038653 discloses a method in which the active components of a pretreatment dragged out with the component into the rinse are cascaded back into the rinsing water prior to the actual pretreatment so as to generate a zirconium-based and/or titanium-based conversion coating. During this prerinsing stage, the fraction of back-cascaded active components causes a partial passivation, which is completed during the subsequent pretreatment. This already allows the actual amount of active components used per component to be treated to be reduced, and thus the material efficiency to be increased.

Notwithstanding this progress with respect to material efficiency, the maintenance complexity of a pretreatment bath during ongoing operation remains enormously high since the amount of the active components must, of course, be continuously maintained within a regulating window predefined by the pretreatment type.

In addition, an enrichment of components dissolved in water takes place during the ongoing operation of a pretreatment bath, which must either be pickled out of the metal surfaces of the treated components, represent reactants of the active components, or are introduced into the pretreatment bath from upstream treatment steps, such as a wet-chemical cleaning step. Depending on the material properties of the components to be treated, the pretreatment type, and the preceding treatment steps and process engineering control, a pretreatment bath thus strives to achieve a steady-state equilibrium, wherein at times equilibrium concentrations are desired for certain components which may adversely affect the result of the pretreatment. It is therefore not sufficient to only replenish active components. Rather, it is frequently also necessary to use chemicals having a regulating effect, so as to prevent the quality of the pretreatment from worsening during ongoing operation.

DE 10 2008 014465, for example, reports with respect to the anti-corrosive treatment of metallic components by way of pretreatment solutions of fluorometallates of the elements zirconium and/or titanium that it is essential to maintain an optimal molar ratio of fluoride ions to elements from the elements zirconium and/or titanium during a serial pretreatment operation, which is to say during ongoing operation. Furthermore, the metered addition of certain amounts of fluoride scavengers to the pretreatment bath is proposed there to ensure a consistently good quality of the anti-corrosive pretreatment. The fluoride scavengers thus represent chemicals having a regulating effect and, in this specific case, are preferably selected from compounds that release aluminum ions, calcium ions and/or iron ions. In this context, it is in turn established there that an excessively high relative content of aluminum ions in the pretreatment bath inhibits the titanium-based and/or zirconium-based conversion coating formation, in particular on the steel surfaces of the components, which tends to result in lower layer coatings and thus in insufficient corrosion protection.

Each addition of a fluoride scavenger as a chemical having a regulating effect so as to maintain the performance of the pretreatment thus must result in exactly predictable concentrations of the active components in the pretreatment bath; otherwise, it cannot be ensured that the serial pretreatment of components takes place under optimal process conditions, which is to say adhering to the empirically found substance parameter limits. In this regard, there is the added difficulty of directly metrologically determining, i.e. directly measuring, the amount of total fluoride or free fluoride since conventional methods are based on the determination by way of ion-selective electrodes, and thus are based on chemical equilibriums that are slow to materialize. Deriving the actual variable for setting the target variable by way of fluoride scavengers is thus subject to a lack of precision in terms of time, which depending on the manufacturing process may be in the order of magnitude of the treatment time of the metallic component. A consistent quality of the serial anti-corrosive pretreatment by way of acidic aqueous pretreatment solutions of fluorometallates of the elements zirconium and/or titanium can thus only be ensured with high analytical and procedural complexity and, last but not least, through the use of considerable amounts of regulating chemicals.

It is thus the object of the present invention to considerably simplify the process engineering complexity for monitoring and controlling the process-relevant bath parameters in the serial anti-corrosive treatment of components comprising metallic surfaces by way of acidic aqueous pretreatment solutions of water-soluble compounds of the elements zirconium and/or titanium, while considerably increasing the material efficiency regarding the use of regulating bath chemicals. Furthermore, it was the object to optimize the process to the effect that a reliable anti-corrosive conversion based on the elements zirconium and/or titanium takes place, in particular on the iron surfaces of the components treated in a serial operation, which then, in interaction with an organic primer coating or an organic dip coating, meets the high requirements with regard to permanent corrosion protection.

This object is achieved by a method for the anti-corrosive treatment of a plurality of metallic surfaces of components comprising zinc and/or iron in a serial operation, in which each of these components is brought in contact with a passivating aqueous pretreatment solution located in a system tank at a temperature of less than 50° C., wherein the passivating aqueous pretreatment solution comprises one or more water-soluble compounds of the elements zirconium and/or titanium and one or more water-soluble compounds that represent a source for fluoride ions, and the bringing in contact takes place for such a time that a layer coating of at least 0.1 mmol/m$^2$, based on the elements zirconium and/or titanium, results on the metallic surfaces of zinc and/or iron, however none of these metallic surfaces has a layer coating of more than 0.7 mmol/m$^2$, based on the elements zirconium and/or titanium, and wherein, during the anti-corrosive treatment of the components in a serial operation, a portion of the passivating aqueous pretreatment solution of the system tank is discarded and replaced with, in sum, at least equal parts by volume of one or more replenishment solutions by way of metered addition into the system tank in such a way that the concentration of the elements zirconium and/or titanium in the passivating aqueous pretreatment solution in the form of water-soluble compounds is maintained, furthermore characterized in that a concentration of the elements zirconium and/or titanium in the passivating aqueous pretreatment solution in the form of water-soluble compounds of at least 0.05 mmol/L, but in total of less than 0.8 mmol/L, is maintained in the system tank, and the molar ratio of the total amount of fluorine in the form of water-soluble compounds that represent a source for fluoride ions (hereafter "total amount of fluorine") to the total amount of the elements zirconium and/or titanium in the form of water-soluble compounds (hereafter "total amount of the elements zirconium and/or titanium") in the added total volume of replenishment solutions is smaller than the same ratio in the passivating aqueous pretreatment solution, but no smaller than 4.5, and the discarded amount of passivating aqueous pretreatment solution in liters per serially treated square meter of metallic surfaces of zinc and iron assumes at least the following value, which is to say is greater than or equal to the following value:

$$VW = \frac{z_E - 2.4}{2.8\ \text{mmol}\ L^{-1} - c_B^{Me}(z_E - 6)} \cdot 10^{-1}\ \text{mmol}\ m^{-2} \tag{I}$$

where:

VW: discarded amount of pretreatment solution in L/m$^2$;

$C_B^{Me}$: concentration of zirconium and/or titanium in the pretreatment solution in mmol/L;

$Z_E$: molar ratio of the total amount of fluorine to the total amount of the elements zirconium and/or titanium in the added total volume of the replenishment solutions, with the proviso that the following applies:

$$z_E < \frac{2.8\ \text{mmol}\ L^{-1}}{c_B^{Me}} + 6.$$

By regulating the discarded amount, the method according to the invention causes the free fluoride fraction in the pretreatment solutions not to exceed any values which already result in a structural change of the conversion coating, which is regularly accompanied by a deterioration of the anti-corrosive properties and paint adhesion.

In a preferred embodiment of the method according to the invention, the discarded amount of pretreatment solution for achieving the same purpose assumes at least the following value:

$$VW = \frac{3 \cdot (z_E - 2.4)}{2.8\ \text{mmol}\ L^{-1} - c_B^{Me}(z_E - 6)} \cdot 10^{-1}\ \text{mmol}\ m^{-2}, \tag{I'}$$

and particularly preferably at least the following value:

$$VW = \frac{7 \cdot (z_E - 2.4)}{2.8\ \text{mmol}\ L^{-1} - c_B^{Me}(z_E - 6)} \cdot 10^{-1}\ \text{mmol}\ m^{-2}, \tag{I''}$$

where variables for Formula (I') and (II") are as defined in Formula (I).

According to the invention, the discarded amount is the liquid volume of pretreatment solution standardized to the unit of surface area (1 m$^2$) of the components to be treated which leaves the system tank during the serial pretreatment due to passive drag out or due to a continuous or discontinuous spillover per square meter of a treated component.

A serial pretreatment according to the present invention exists when a plurality of components are brought in contact with the pretreatment solution located in the system tank, wherein the bringing in contact of the individual components takes place consecutively, and thus chronologically separately from one another. The system tank is the receptacle in which the pretreatment solution for the purpose of the passivating serial pretreatment is located.

The range for the layer coating to be set in the method according to the invention, based on the elements Zr and/or Ti, can be determined by way of X-ray fluorescence (XRF) spectroscopy after calibration based on metal surfaces coated with solutions having a known molarity of $H_2ZrF_6$ and $H_2TiF_6$ using the dry-in-place method. The solutions having a known molarity are applied in a defined wet film thickness to produce the calibration sample metal sheets, and the wet film is thereafter fully dried. The determination of the actual layer coating according to the present invention can take place based on these calibration sample metal sheets both after the pretreated and rinsed surfaces of the components have been dried, or after pretreatment and the first rinse stage, for example after a body has been rinsed immediately after the pretreatment upon passing a so-called wet hold ring, in which rinsing water is applied to the body through multiple spray valves.

Compounds are "water-soluble" within the meaning of the present invention if the solubility thereof in deionized water having a conductivity of no more than 1 $\mu Scm^{-1}$ at a temperature of 20° C. is at least 1 g/L.

As is apparent from the solution to the problem, the concentration of the elements zirconium and/or titanium can be maintained by the metered addition of one or more replenishment solutions into the system tank. In the added total volume of the replenishment solution or of the replenishment solutions, the molar ratio of the total amount of fluorine in the form of compounds dissolved in water to the total amount of the elements zirconium and/or titanium in the form of compounds dissolved in water should not be smaller than 4.5. Below this value, the metering of a required amount of compounds of the elements zirconium and/or titanium dissolved in water cannot be carried out in a practicable manner since the compounds tend to form colloidal solutions, and thus hardly soluble precipitations, making it almost impossible to reliably dose such a replenishment solution in an amount that is useful for maintaining the active components in the pretreatment solution. In a preferred embodiment of the method according to the invention, the molar ratio of the total amount of fluorine to the total amount of the elements zirconium and/or titanium in the added total volume of the replenishment solutions is thus no less than 5.0, and particularly preferably no less than 5.5. Conversely, it is preferred that the same ratio in the added total volume of the replenishment solutions in methods according to the invention is less than $$\frac{0.4\ \text{mmol}\ L^{-1}}{c_B^{Me}} + 6$$

where the variable is as defined in Formula (I);

or alternatively less than 9.25, so that the necessary discarded amount of pretreatment solution has an upper limit at which the methods according to the invention can essentially still be operated in an economically useful manner for all covered pretreatment solutions.

For the sake of linguistic simplification, hereafter reference will only be made to one replenishment solution, and nonetheless this shall also cover the case in which several identically or differently composed replenishment solutions are metered into the system tank to compensate for the discarded amount and maintain the concentration of zirconium and/or titanium. So when hereafter reference is made to a replenishment solution, and specifically to an extensive or specific property of the same, this shall always cover the sum of all added replenishment solutions, and the resultant averaged extensive or specific properties from an overall perspective.

Due to the controlled discarding of bath solution, and the attendant addition of replenishment solution, the method according to the invention achieves that the enrichment of free fluoride in the pretreatment solution is limited in such a way that no disadvantageous effect on the conversion coating based on the elements zirconium and/or titanium occurs. Additionally, it shall be emphasized that the method according to the invention makes the metered addition of fluoride scavengers superfluous, which is to say compounds that bind free fluorides and thereby reduce the concentration thereof, since the free fluoride concentration is controlled entirely via the discarding of bath solution. For the predefined general conditions with respect to the concentration of active components in the pretreatment solution and the intended layer coating, the minimum discarded amount should be set to a maximum of 0.7 mmol/$m^2$, based on the elements zirconium and titanium, in accordance with the semi-empirically found term (1) or the preferred semi-empirically found terms (1') and (1"). These terms for the minimum discarded amount are only dependent on the specific concentration of zirconium and/or titanium in the pretreatment solution and the ratio of the elements fluorine in the form of compounds dissolved in water to the total amount of zirconium and/or titanium in the form of compounds dissolved in water in the replenishment solution. To adhere to optimal process conditions during the pretreatment, accordingly only the concentration of active components in the form of the elements zirconium and/or titanium must be determined, which must be checked regularly anyhow for sufficient conversion coating formation. In the method according to the invention, it is superfluous to monitor the amount of free fluoride in the pretreatment solution.

Since, as was already described, the metered addition of fluoride scavengers to the pretreatment solution can be dispensed with, the fraction of these in the volume of the replenishment solution added according to the invention is low for reasons of material efficiency. Accordingly, methods according to the invention are preferably methods for which the molar ratio of the total amount of the elements zirconium and/or titanium to the respective total amount of one of the elements calcium, magnesium, aluminum, boron, iron, manganese or tungsten in the form of water-soluble compounds in the added total volume of the replenishment solution is greater than 5:1, and particularly preferably greater than 10:1.

A further advantage of the method according to the invention is that sufficient layer coatings of zirconium and/or titanium for corrosion protection and for the adhesion to a subsequently applied organic primer are already achieved at comparatively low concentrations of active components. In this context, preferred methods according to the invention for material efficiency are those in which the passivating aqueous pretreatment solution in the system tank in total comprises less than 0.65 mmol/L, particularly preferably less than 0.55 mmol/L, and in particular preferably in total less than 0.325 mmol/L, water-soluble compounds of the elements zirconium and/or titanium. A low concentration of active components also causes the steady-state fraction of these compounds introduced into a downstream rinsing stage due to carry-over to be low. This is regularly likewise advantageous since an additional contact period of the components with compositions comprising active components frequently results in a deterioration of the anti-corrosive properties, so that the rinsing stage usually must be kept substantially free from carried over fractions from the system tank of the pretreatment. In the preferred embodiments of the method according to the invention, this is not necessary, and special measures for reducing the fractions of active components in the system tank of the rinsing stage, for example setting an increased spillover, which is to say discarded amount of rinsing solution, may be dispensed with.

For a particularly economical method according to the invention and to ensure that a sufficient amount of free fluoride for a conversion coating formation to take place under customary process conditions is present in the pretreatment solution of the system tank, it is preferred if the discarded amount of passivating aqueous pretreatment solution is no greater than the following value in liters per serially treated square meter of metallic component:

$$VW = \frac{7(z_E - 2.4)}{0.4\ \text{mmol}\ L^{-1} - c_B^{Me}(z_E - 6)} \cdot 10^{-1}\ \text{mmol}\ m^{-2} \qquad \text{(II)}$$

where:

VW represents the discarded amount of pretreatment solution in $L/m^{2-}$;

$C_B^{Me}$ represents concentration of zirconium and/or titanium in the pretreatment solution in mmol/L; and $Z_E$ represents molar ratio of the total amount of fluorine to the total amount of the elements zirconium and/or titanium in the added total volume of the replenishment solutions.

For good stability and conversion of the metallic surfaces of the components, it is furthermore advantageous if the pH value of the passivating aqueous pretreatment solution in a preferred method according to the invention is no less than 3.0, and particularly preferably no less than 3.5, but preferably no greater than 5.0, and particularly preferably no greater than 4.5.

The "pH value" according to the present invention corresponds to the negative logarithm of the hydronium ion activity at 20° C. and can be determined by way of a pH-sensitive glass electrode.

The method according to the invention is preferably carried out at comparatively low temperatures so that evaporation losses in the system tank of the pretreatment solution can be neglected. In a preferred method according to the invention, the temperature of the passivating aqueous pretreatment solution is accordingly no greater than 45° C., particularly preferably no greater than 40° C., and particularly preferably no greater than 35° C.

The discarding of pretreatment solution provided for in the method according to the invention can take place only quasi-continuously or discontinuously during the anti-corrosive treatment of the plurality of components for process-related reasons. The serial treatment process according to the invention causes a certain amount of pretreatment solution to irrevocably leave the system tank along with every treated component. The fraction of discard dragged out with every treated component is, by nature, discrete and thus discontinuous and dependent on the specific treatment conditions and the geometry of the components. Furthermore, the dragged out fraction of discard can only conditionally be controlled, for example by rotating or tilting the components during immersion into the pretreatment solution or by blowing off the components when the components are lifted out of the system tank of the pretreatment. Such process measures, however, are complex and usually not justified by any particular added value. The methods in the prior art, however, are in principle operated in such a way that the components do not regularly drag out pretreatment solution on an exhaustive scale and usually less than 50 mL per square meter of treated surface is dragged out. When hereafter quasi-continuous or discontinuous discarding is referred to, this only addresses the actively discharged volume of pretreatment solution, and it must be taken into consideration that the passively dragged out fraction of discard is always discontinuously discarded with every treated component.

According to the invention, the discarding of passivating aqueous pretreatment solution thus preferably takes place both by dragging out pretreatment solution with every component of the series of components to be treated, and by actively discharging pretreatment solution, each out of the system tank of the pretreatment.

For discontinuous discarding, the volume of pretreatment solution to be actively discharged can be adapted to the layer coating deposited on the components in the pretreatment step, based on the elements zirconium and/or titanium, so as to discharge as much pretreatment solution as is needed for a layer coating of zirconium and/or titanium to be achieved, but no more than is necessary, and thus to proceed as economically as possible.

During discontinuous operation, preferred methods are those in which the discontinuously discarding $VW_d$ of passivating aqueous pretreatment solution takes place after a defined number n of components i has been pretreated, wherein the discontinuous discarding assumes at least the following value in liters for a serially treated number n of components i:

$$VW_d = \frac{z_E - 2.4}{2.8\ \text{mmol}\ L^{-1} - c_B^{Me}(z_E - 6)} \cdot \sum_i^n (x_i^{Zn} \cdot S_i^{Zn} + x_i^{Fe} \cdot S_i^{Fe}) \cdot A_i - VW_a^n \qquad \text{(III)}$$

where:

$VW_d$: discontinuously discarded amount in liters;

$VW_a^n$: discarded amount due to drag-out by n components in liters, with the proviso that the following applies:

$$VW_a^n \leq \frac{z_E - 2.4}{2.8\ \text{mmol}\ L^{-1} - c_B^{Me}(z_E - 6)} \cdot \sum_i^n (x_i^{Zn} \cdot S_i^{Zn} + x_i^{Fe} \cdot S_i^{Fe}) \cdot A_i;$$

$x_i^{Zn}$: proportion of zinc surfaces based on the total surface of zinc and iron of the ith serially treated component;

$x_i^{Fe}$: proportion of iron surfaces based on the total surface of zinc and iron of the ith serially treated component:

$S_i^{Zn}$: layer coating in $mmol/m^2$, based on the elements zirconium and/or titanium on the anti-corrosively pretreated zinc surfaces of the ith serially treated component; and $S_i^{Fe}$: layer coating in mmol/m$^2$, based on the elements zirconium and/or titanium on the anti-corrosively pretreated iron surfaces of the ith serially treated component;

$A_i$: total surface area of the metallic surfaces of zinc and iron of the ith serially treated component; and n: positive natural number $\{n \in N | n \geq 1\}$ According to the invention, a preferred upper limit for the discontinuously discharged pretreatment solution preferably involves methods in which the discontinuously discarded amount in liters for a serially treated number n of components i does not exceed the value $$VW_d = \frac{z_E - 2.4}{0.4\ \text{mmol}\ L^{-1} - c_B^{Me}(z_E - 6)} \cdot \sum_i^n (x_i^{Zn} \cdot S_i^{Zn} + x_i^{Fe} \cdot S_i^{Fe}) \cdot A_i - VW_a^n \quad \text{(IV)}$$

wherein the following condition is met for the molar ratio of the total amount of fluorine to the total amount of the elements zirconium and/or titanium in the replenishment solution:

$$z_E < \frac{0.4\ \text{mmol}\ L^{-1}}{c_B^{Me}} + 6.$$

where variables for Formula (IV) are as defined in Formula (III).

The discarding to be set according to the invention can, of course, also be carried out quasi-continuously. For this operating mode, it is preferred if the discarding takes place by actively discharging passivating aqueous pretreatment solution and continuously replacing discarded pretreatment solution with replenishment solution during the pretreatment of the components in a serial operation, and particularly preferably by feeding a constant volume flow of replacing replenishment solution into the system tank of the pretreatment, wherein the continuous discarding of passivating aqueous pretreatment solution is preferably predominantly implemented by way of spillover of an open system tank.

"Predominantly" in this context shall be understood to mean that more than 50%, and preferably more than 80%, of the portion of the discarded pretreatment solution that can be controlled is removed from the system tank by way of spillover, which includes the portion of the discarded amount inevitably caused by the exhaustive effect of the components or by the wet film adhering to the components. Spillover thus represents a particularly preferred way of discarding by way of active discharge. As an alternative, the continuous discarding can also be implemented by discharging a constant volume flow from the system tank.

In a preferred method according to the invention, the continuously discarded amount assumes at least the following value in liters per serially treated square meter of metallic surfaces of zinc and iron, so as to discharge as much pretreatment solution as is needed for a layer coating of zirconium and/or titanium to be achieved, but no more than is necessary, and thus to proceed as economically as possible:

$$VW_c = \frac{z_E - 2.4}{2.8\ \text{mmol}\ L^{-1} - c_B^{Me}(z_E - 6)} \cdot (\bar{x}^{Zn} \cdot \bar{S}^{Zn} + \bar{x}^{Fe} \cdot \bar{S}^{Fe}) \cdot \bar{A} - \overline{VW}_a \quad \text{(V)}$$

where:

$VW_c$: continuously discarded amount in liters;

$\overline{VW}_a$: averaged discarded amount due to drag-out in liters, with the proviso that the following applies:

$$\overline{VW}_n \leq \frac{z_E - 2.4}{2.8\ \text{mmol}\ L^{-1} - c_B^{Me}(z_E - 6)} \cdot (\bar{x}^{Zn} \cdot \bar{S}^{Zn} + \bar{x}^{Fe} \cdot \bar{S}^{Fe}) \cdot \bar{A};$$

$\bar{x}^{Zn}$: averaged proportion of zinc surfaces based on the total surfaces areas of zinc and iron of serially treated components;

$\bar{x}^{Fe}$: averaged proportion of iron surfaces based on the total surfaces areas of zinc and iron of serially treated components;

$\bar{S}^{Zn}$: averaged layer coating in mmol/m$^2$, based on the elements zirconium and/or titanium on the anti-corrosively pretreated zinc surfaces of the serially treated components; and $\bar{S}^{Fe}$: averaged layer coating in mmol/m$^2$, based on the elements zirconium and/or titanium on the anti-corrosively pretreated iron surfaces of the serially treated components $\bar{A}$: averaged surface area of the components in m$^2$.

In this regard, it shall be noted that the respective average values are always averaged over the same treated metallic surface, wherein the smallest unit over which averaging can take place is the respective component to be treated itself.

According to the invention, a preferred upper limit for the continuously discharged pretreatment solution preferably involves methods in which the continuously discarded amount in liters per serially treated square meter of metallic surfaces of zinc and iron does not exceed the value $$VW_c = \frac{z_E - 2.4}{0.4\ \text{mmol}\ L^{-1} - c_B^{Me}(z_E - 6)} \cdot (\bar{x}^{Zn} \cdot \bar{S}^{Zn} + \bar{x}^{Fe} \cdot \bar{S}^{Fe}) \cdot \bar{A} - \overline{VW}_a \quad \text{(VI)}$$

where variables for Formula (VI) are as defined in Formula (V) and wherein the following condition is met for the molar ratio of the total amount of fluorine to the total amount of the elements zirconium and/or titanium in the replenishment solution:

$$z_E < \frac{0.4\ \text{mmol}\ L^{-1}}{c_B^{Me}} + 6$$

The discarded amount and the layer coating are variables that are independent of one another, so that, both in quasi-continuous and in discontinuous operation, it suffices to measure the actual layer coating (;$\bar{s}$, $s_1$;) when having knowledge of the bath concentration of zirconium and/or titanium, so as to predefine the target condition with respect to the layer coating for further components, and a paint primer providing optimal protection against corrosion, by setting the continuously or discontinuously discarded amount. In the method according to the invention, effective control is thus possible for the portion of the discarded amount that is to be actively discharged, the control only requiring the amount of zirconium and/or titanium in the pretreatment solution and on the iron and zinc surfaces to be monitored.

The layer coatings (;$\bar{s}$, $s_1$;), based on the elements zirconium and/or titanium, can be determined as described above immediately after the pretreatment of the component by way of X-ray fluorescence spectroscopy on the respective treated metal surface. In a preferred embodiment, the discontinuous discarding is carried out immediately after the first rinsing stage, wherein the first rinsing stage is preferably carried out by way of a so-called wet hold ring by spraying the components with the first rinsing water, wherein the rinsing water, in turn, is preferably at least partially fed into the pretreatment solution as part of the replenishment solution. In this way, it is ensured that the determination of the layer coating takes place as concurrently with the actual pretreatment as possible, so that optimal setting of the pretreatment solution can take place almost directly by controlling the discarded amount based on the layer coating. In this context, it is also preferred that the discarding takes place quasi-continuously or, if discontinuously, preferably after every pretreatment of only a low number n of components.

In a simplified and thus preferred embodiment of the methods according to the invention in which the discarding takes place at least partially by the active continuous or discontinuous discharge of pretreatment solution, in each case at least the following discarded amount should be set:

$$VW_d = \frac{z_E - 2.4}{2.8\ \text{mmol}\ L^{-1} - c_B^{Me}(z_E - 6)} \cdot 0.1\ \text{mmol}\ m^{-2} \cdot \sum_i^n (x_i^{Zn} + x_i^{Fe}) \cdot A_i - VW_a^n \quad (3')$$

particularly preferably at least:

$$VW_d = \frac{z_E - 2.4}{2.8\ \text{mmol}\ L^{-1} - c_B^{Me}(z_E - 6)} \cdot 0.3\ \text{mmol}\ m^{-2} \cdot \sum_i^n (x_i^{Zn} + x_i^{Fe}) \cdot A_i - VW_a^n \quad (3'')$$

in particular preferably at least:

$$VW_d = \frac{z_E - 2.4}{2.8\ \text{mmol}\ L^{-1} - c_B^{Me}(z_E - 6)} \cdot 0.7\ \text{mmol}\ m^{-2} \cdot \sum_i^n (x_i^{Zn} + x_i^{Fe}) \cdot A_i - VW_a^n \quad (3''')$$

or at least:

$$VW_c = \frac{z_E - 2.4}{2.8\ \text{mmol}\ L^{-1} - c_B^{Me}(z_E - 6)} \cdot 0.1\ \text{mmol}\ m^{-2} \cdot \overline{A} \cdot \overline{VW}_a \quad (5')$$

particularly preferably at least:

$$VW_c = \frac{z_E - 2.4}{2.8\ \text{mmol}\ L^{-1} - c_B^{Me}(z_E - 6)} \cdot 0.3\ \text{mmol}\ m^{-2} \cdot \overline{A} \cdot \overline{VW}_a \quad (5'')$$

in particular preferably at least:

$$VW_c = \frac{z_E - 2.4}{2.8\ \text{mmol}\ L^{-1} - c_B^{Me}(z_E - 6)} \cdot 0.7\ \text{mmol}\ m^{-2} \cdot \overline{A} \cdot \overline{VW}_a \quad (5''')$$

The simplification in setting the at least required discontinuously or continuously discarded amount ($VW_c$, $VW_d$) is that the setting takes place independently from the layer coating, wherein, however, it is accepted that the fraction of free fluoride is within the respective limits which only minimally ensure sufficient conversion coating formation or a deterioration of the same that is not yet disadvantageous.

In a particular embodiment of the method according to the invention, at least 80% of the surfaces of the component is formed by surfaces of the substrates iron, zinc and aluminum, wherein particularly preferably at least 50% of the surfaces of the component represents metallic surfaces of the substrates iron and/or zinc, wherein, in turn, preferably at least 10%, and particularly preferably at least 20%, of the metallic surfaces of the component is selected from surfaces of the substrate iron. The surfaces of the substrates iron, zinc and aluminum also cover the alloys thereof, provided the main alloying constituent is formed by the respective substrate element.

The method according to the invention can be followed by further method steps for surface treatment. In a preferred method, a coating step using an organic binder system, preferably a powder coating or dip coating step, particularly preferably an electro dip-coating step, and in particular preferably a cathodic electro dip-coating step, is carried out after the bringing into contact with the passivating aqueous pretreatment solution, with or without interposed rinsing steps. In the case of the subsequent dip coating step, and in particular a subsequent electro dip-coating step, preferably no drying step takes place after the bringing into contact with the passivating aqueous pretreatment solution and prior to the dip coating step, wherein a drying step is characterized in that technical measures are carried out for drying the surfaces of the component, for example by supplying thermal energy or by supplying a drying air current.

After the components have been treated according to the invention in a serial operation, which is to say after the bringing into contact with the passivating aqueous pretreatment solution, and prior to a possible coating step using an organic binder system, in a preferred embodiment no further treatment step is carried out using an aqueous solution, in which the solution comprises more than 10% of the fraction of the passivating aqueous pretreatment solution of water-soluble compounds of the elements zirconium and/or titanium, and in particular no further such treatment step which is used to form a coating comprising substrate-foreign metallic or metalloid elements having a layer coating of more than 0.1 mmol/m$^2$ based on these substrate-foreign elements, on at least one metal surface of the component. As was already mentioned, such a post-treatment is frequently harmful to the previously generated passivation by way of the pretreatment solution. "Substrate-foreign" in this context is any element that is not a main alloying constituent of the particular substrate.

In a further preferred method according to the invention, a rinsing step is carried out immediately after the bringing into contact with the passivating aqueous pretreatment solution by bringing the components in contact with a rinsing solution located in a system tank, wherein, during the anti-corrosive treatment of the components in a serial operation, a portion of the rinsing solution is discarded and replaced with at least equal parts by volume of a replenishing rinsing solution, which in total comprises less than $10^{-5}$ mol/L water-soluble compounds of the elements zirconium and/or titanium, and preferably less than $10^{-4}$ mol/L water-soluble compounds that represent a source for fluoride ions, based on the element fluorine. In this case as well, it is to be ensured that an enrichment of active components from the passivating aqueous pretreatment solution in the rinsing solution is tolerated only up to a certain degree since otherwise damage to the passivation layer cannot be completely precluded.

For economic reasons, however, it is preferred that the discarded amount of rinsing solution in the rinsing step per serially treated total surface of the components is less than 2 L/m2. Due to the comparatively low bath concentration of zirconium and/or titanium in the passivating aqueous pretreatment solution, this upper limit, however, can always be maintained, without necessitating additional measures for processing the rinsing solution.

It is furthermore preferred if at least a portion of the discarded rinsing solution is fed as a replenishment solution into the system tank of the passivating aqueous pretreatment, wherein regularly in addition the dosing of a concentrated replenishment solution will be necessary to maintain the bath concentration of water-soluble compounds of the elements zirconium and/or titanium in the passivating aqueous pretreatment solution.

Within the scope of the present invention, the water-soluble compounds of the elements zirconium and/or titanium are thus not limited to a certain class of compounds, either for provision in the pretreatment solution or in the replenishment solutions; preferred, however, are oxyfluorides of the respective elements, and the fluoro acids and the salts thereof are particularly preferred. However, it is also possible to use basic zirconium carbonate or titanyl sulfate, wherein these compounds then, however, due to the ratio of fluorides dissolved in water to compounds of the elements zirconium and/or titanium dissolved in water, as predefined according to the invention, must be reacted with a corresponding amount of fluoride-releasing compounds so as to be able to form an adequate replenishment solution.

Water-soluble compounds that represent a source for fluoride ions, and inasmuch can be used for the method according to the invention, include, for example, hydrofluoric acid, ammonium bifluoride and sodium fluoride, or the aforementioned oxyfluorides and fluoro acids of the elements zirconium and/or titanium.

What is claimed is:

1. A method for anti-corrosive treatment of metallic surfaces, in a serial operation, comprising steps of:

a. contacting in a serial operation a plurality of metallic surfaces of components comprising zinc and/or iron with a passivating aqueous pretreatment solution located in a system tank at a temperature of less than 50° C., the passivating aqueous pretreatment solution comprising one or more water-soluble compounds of the elements zirconium and/or titanium and one or more water-soluble compounds that represent a source for fluoride ions, for a time such that a layer coating of 0.1 mmol/m$^2$ to 0.7 mmol/m$^2$, based on the elements zirconium and/or titanium, results on the metallic surfaces of zinc and/or iron; and, b. during the anti-corrosive treatment, discarding a portion of the passivating aqueous pretreatment solution of the system tank and replacing said portion with, in sum, at least equal parts by volume of one or more replenishment solutions by addition into the system tank such that concentration of the elements zirconium and/or titanium in total in the passivating aqueous pretreatment solution in the form of water-soluble compounds is maintained at 0.05 mmol/L to less than 0.8 mmol/L, and a molar ratio of a total amount of fluorine in the form of water-soluble compounds that represent a source for fluoride ions to a total amount of the elements zirconium and/or titanium in the form of water-soluble compounds in an added total volume of replenishment solutions is less than the same molar ratio in the passivating aqueous pretreatment solution, but no less than 4.5, and a discarded amount of passivating aqueous pretreatment solution in liters per serially treated square meter of metallic surfaces of zinc and iron exhibits at least a value according to Formula I:

$$VW = \frac{z_E - 2.4}{2.8\ \text{mmol}\ L^{-1} - c_B^{Me}(z_E - 6)} \cdot 10^{-1}\ \text{mmol}\ m^{-2} \qquad \text{(I)}$$

where

VW: discarded amount of pretreatment solution in L/m$^2$;

$C_B^{Me}$: concentration of zirconium and/or titanium in the pretreatment solution in mmol/L;

$Z_E$: molar ratio of the total amount of fluorine in the form of water-soluble compounds that represent a source for fluoride ions to the total amount of the elements zirconium and/or titanium in the form of water-soluble compounds in the added total volume of replenishment solutions, with the proviso that the following applies:

$$z_E < \frac{2.8\ \text{mmol}\ L^{-1}}{c_B^{Me}} + 6.$$

2. The method according to claim 1, wherein the molar ratio $z_E$ meets:

$$z_E < \frac{0.4\ \text{mmol}\ L^{-1}}{c_B^{Me}} + 6.$$

3. The method according to claim 2, wherein the discarded amount of passivating aqueous treatment solution is no greater than a value according to Formula II, in liters per serially treated square meter of metallic component:

$$VW = \frac{7(z_E - 2.4)}{0.4\ \text{mmol}\ L^{-1} - c_B^{Me}(z_E - 6)} \cdot 10^{-1}\ \text{mmol}\ m^{-2} \qquad \text{(II)}$$

where

VW: discarded amount of pretreatment solution in L/m$^2$:

$C_B^{Me}$: concentration of zirconium and/or titanium in the pretreatment solution in mmol/L;

$Z_E$: molar ratio of the total amount of fluorine in the form of water-soluble compounds that represent a source for fluoride ions to the total amount of the elements zirconium and/or titanium in the form of water-soluble compounds in the added total volume of replenishment solutions.

4. The method according to claim 1, wherein the molar ratio of the total amount of fluorine in the form of water-soluble compounds that represent a source for fluoride ions to the total amount of the elements zirconium and/or titanium in the form of water-soluble compounds in the added total volume of the replenishment solutions is no less than 5.0.

5. The method according to claim 1, wherein the molar ratio of the total amount of the elements zirconium and/or titanium in the form of water-soluble compounds to a respective total amount of one of the elements calcium, magnesium, aluminum, boron, iron, manganese or tungsten in the form of water-soluble compounds in the added total volume of the replenishment solutions is greater than 5:1.

6. The method according to claim 1, wherein the passivating aqueous pretreatment solution in the system tank in total comprises less than 0.55 mmol/L water-soluble compounds of the elements zirconium and/or titanium.

7. The method according to claim 1, wherein the passivating aqueous pretreatment solution has a pH value of no less than 3.0, and no greater than 5.0.

8. The method according to claim 1, wherein the passivating aqueous pretreatment solution has a temperature of no greater than 40° C.

9. The method according to claim 1, wherein the discarding of passivating aqueous pretreatment solution takes place by dragging out pretreatment solution with every component of the series of components to be treated, and by actively discharging pretreatment solution, each out of the system tank of the pretreatment.

10. The method according to claim 9, wherein the discarding by way of active discharging of passivating aqueous pretreatment solution takes place discontinuously after a defined number n of components i has been pretreated, the discontinuous discarding assuming at least a value according to Formula III in liters for a serially treated number n of components i:

$$VW_d = \frac{z_E - 2.4}{2.8\ \text{mmol}\ L^{-1} - c_B^{Me}(z_E - 6)} \cdot \sum_i^n (x_i^{Zn} \cdot S_i^{Zn} + x_i^{Fe} \cdot S_i^{Fe}) \cdot A_i - VW_a^n \quad \text{(III)}$$

where $VW_d$: discontinuously discarded amount in liters;

$VW_a^n$: discarded amount due to drag-out by n components in liters, with the proviso that the following applies:

$$VW_a^n \leq \frac{z_E - 2,4}{2.8\ \text{mmol}\ L^{-1} - c_B^{Me}(z_E - 6)} \cdot \sum_i^n (x_i^{Zn} \cdot S_i^{Zn} + x_i^{Fe} \cdot S_i^{Fe}) \cdot A_i;$$

where:

$x_i^{Zn}$: proportion of zinc surfaces based on the total surface of zinc and iron of the ith serially treated component;

$x_i^{Fe}$: proportion of iron surfaces based on the total surface of zinc and iron of the ith serially treated component;

$S_i^{Zn}$: layer coating in mmol/m$^2$, based on the elements zirconium and/or titanium on the anti-corrosively pretreated zinc surfaces of the ith serially treated component; and $S_i^{Fe}$: layer coating in mmol/m$^2$, based on the elements zirconium and/or titanium on the anti-corrosively pretreated iron surfaces of the ith serially treated component;

$A_i$: total surface area of the metallic surfaces of zinc and iron of the ith serially treated component; and n: positive natural number $\{n \in N | n \geq 1\}$.

11. The method according to claim 10, wherein the discontinuously discarded amount in liters for a serially treated number n of components i does not exceed a value according to Formula IV $$VW_d = \frac{z_E - 2.4}{0.4\ \text{mmol}\ L^{-1} - c_B^{Me}(z_E - 6)} \cdot \sum_i^n (x_i^{Zn} \cdot S_i^{Zn} + x_i^{Fe} \cdot S_i^{Fe}) \cdot A_i - VW_a^n \quad \text{(IV)}$$

and wherein the molar ratio $z_E$ in the added total volume of the replenishment solutions meets:

$$z_E < \frac{0.4\ \text{mmol}\ L^{-1}}{c_B^{Me}} + 6.$$

12. The method according to claim 9, wherein the discarding takes place by actively discharging passivating aqueous pretreatment solution and continuously replacing discarded pretreatment solution with one or more replenishment solutions during the pretreatment of the components in a serial operation by feeding a constant volume flow of replacing replenishment solution into the system tank of the pretreatment, the continuous discarding of passivating aqueous pretreatment solution being implemented predominantly by way of spillover of the system tank.

13. The method according to claim 12, wherein the continuously discarded amount assumes at least a value according to Formula V, in liters per serially treated square meter of metallic surfaces of zinc and iron:

$$VW_c = \frac{z_E - 2.4}{2.8\ \text{mmol}\ L^{-1} - c_B^{Me}(z_E - 6)} \cdot (\overline{x}^{Zn} \cdot \overline{S}^{Zn} + \overline{x}^{Fe} \cdot \overline{S}^{Fe}) \cdot \overline{A} - \overline{VW}_a \quad \text{(V)}$$

where:

$VW_c$: continuously discarded amount in liters;

$\overline{VW}_a$: averaged discarded amount due to drag-out in liters, with the proviso that the following applies:

$$\overline{VW}_a \leq \frac{z_E - 2.4}{2.8\ \text{mmol}\ L^{-1} - c_B^{Me}(z_E - 6)} \cdot (\overline{x}^{Zn} \cdot \overline{S}^{Zn} + \overline{x}^{Fe} \cdot \overline{S}^{Fe}) \cdot \overline{A};$$

where:

$\overline{x}^{Zn}$: averaged proportion of zinc surfaces based on the total surfaces of zinc and iron of serially treated components;

$\overline{x}^{FE}$: averaged proportion of iron surfaces based on the total surfaces of zinc and iron of serially treated components;

$\overline{S}^{Zn}$: averaged layer coating in mmol/m$^2$, based on the elements zirconium and/or titanium on the anti-corrosively pretreated zinc surfaces of the serially treated components; and $\overline{S}^{Fe}$: averaged layer coating in mmol/m$^2$, based on the elements zirconium and/or titanium on the anti-corrosively pretreated iron surfaces of the serially treated components $\overline{A}$: averaged surface area of the components in m$^2$.

14. The method according to claim 13, wherein the continuously discarded amount in liters per serially treated square meter of metallic surfaces of zinc and iron does not exceed a value according to Formula VI:

$$VW_c = \frac{z_E - 2.4}{0.4\ \text{mmol}\ L^{-1} - c_B^{Me}(z_E - 6)} \cdot \left(\overline{x}^{Zn} \cdot \overline{S}^{Sn} + \overline{x}^{Fe} \cdot \overline{S}^{Fe}\right) \cdot \overline{A} \quad \text{(VI)}$$

and wherein the molar ratio $z_E$ in the added total volume of the replenishment solutions meets:

$$z_E < \frac{0.4\ \text{mmol}\ L^{-1}}{c_B^{Me}} + 6.$$

15. The method according to claim 1, further comprising a dip coating step carried out after the contacting step a.), with or without interposed rinsing steps.

16. The method according to claim 15, wherein, after the contacting step a.), no further treatment step follows using an aqueous solution comprising more than 10% of the concentration of the passivating aqueous pretreatment solution of water-soluble compounds of the elements zirconium and/or titanium.

17. The method according to claim 16, wherein, after the contacting step a.), no further treatment step follows which is used to form a coating comprising substrate-foreign metallic or metalloid elements having a layer coating of more than 0.1 mmol/$m^2$ based on said substrate-foreign elements, on at least one metal surface of the component.

18. The method according to claim 15, further comprising a rinsing step carried out immediately after the contacting step a.), the rinsing step comprising bringing the components in contact with a rinsing solution located in a rinsing solution system tank, wherein, during the anti-corrosive treatment of the components in a serial operation, a portion of the rinsing solution is discarded and replaced with at least equal parts by volume of a replenishing rinsing solution, which in total comprises less than $10^{-5}$ mol/L water-soluble compounds of the elements zirconium and/or titanium, and less than $10^{-4}$ mol/L water-soluble compounds that represent a source for fluoride ions, based on the element fluorine.

* * * * *